United States Patent [19]

McMahon

[11] 4,073,273

[45] Feb. 14, 1978

[54] METHOD AND APPARATUS FOR IMPROVING ENERGY FUELS

[76] Inventor: Roy C. McMahon, 7300 Jarboe, Kansas City, Mo. 64114

[21] Appl. No.: 796,032

[22] Filed: May 11, 1977

Related U.S. Application Data

[63] Continuation of Ser. No. 536,639, Dec. 26, 1974, abandoned.

[51] Int. Cl.[2] ..... F02M 27/04

[52] U.S. Cl. ..... 123/119 E; 123/27 GE

[58] Field of Search ..... 123/27 GE, 119 E, 119 EC, 123/119 ED, 119 EE

[56] References Cited

U.S. PATENT DOCUMENTS

| | | | |
|---|---|---|---|
| 1,358,031 | 11/1920 | Smith | 123/119 E |
| 1,455,088 | 5/1923 | McCabe | 123/119 E |
| 2,926,276 | 2/1960 | Moriya et al. | 123/119 E |
| 3,116,726 | 1/1964 | Kwartz | 123/119 E |
| 3,749,545 | 7/1973 | Velkoff | 123/119 E X |
| 3,761,062 | 9/1973 | King | 123/119 E X |
| 3,805,492 | 4/1974 | King | 123/119 E X |
| 3,830,621 | 8/1974 | Miller | 123/119 E X |

*Primary Examiner*—Charles J. Myhre
*Assistant Examiner*—Ira S. Lazarus
*Attorney, Agent, or Firm*—Fishburn, Gold & Litman

[57] ABSTRACT

The application of an electrostatic field across energy fuels subsequently burned in a reciprocating internal combustion engine improves anti-knock characteristics, thereby increasing available energy for engine operation.

1 Claim, 2 Drawing Figures

METHOD AND APPARATUS FOR IMPROVING ENERGY FUELS

This is a continuation of application Ser. No. 536,639 filed Dec. 26, 1974, now abandoned.

This invention relates to energy fuels and more specifically to a method and apparatus for increasing the available energy in fuels for use in reciprocating internal combustion engines.

In recent years it has become increasingly important to conserve energy fuels. This has become especially critical in the operation of electrical generating plants which utilize large quantities of increasingly scarce liquid and gaseous hydrocarbon fuels.

In utilizing such fuels for powering reciprocating internal combustion engines, the upper limit of efficiency is, in large measure, determined by the tendency of the fuel to detonate before the desired compression is reached in the cylinder. It has now been determined that treating the fuel shortly prior to entry into the engine with an electrostatic field appears to produce a measurable alteration in hydrocarbon composition of the fuel which makes the fuel less susceptible to detonation.

The principal objects of the present invention are: to provide a method and apparatus for improving the available energy of fuels for use in reciprocating internal combustion engines; to provide such a method which is relatively simple to perform and appears to decrease undesirable waste products; to provide such a method and apparatus which are easily utilized in new or existing installations; to provide an inexpensive and low-power consumption device which improves the quality of gaseous fuels entering reciprocating internal combustion engines; and to provide such a method and apparatus which are well suited for their intended purpose.

Other objects and advantages of this invention will become apparent from the following description taken in connection with the accompanying drawings wherein are set forth, by way of illustration and example, certain embodiments of this invention.

Figure 2:
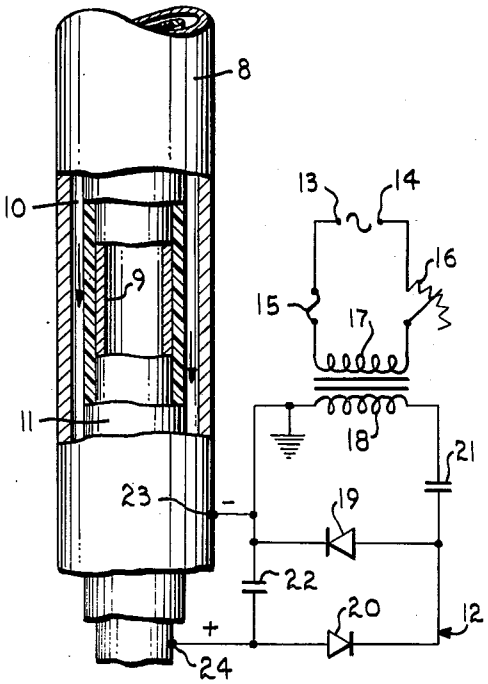
FIG. 2 is a fragmentary, partially schematic, perspective view, on a larger scale, showing a portion of the fuel treater with parts broken away to reveal the interior thereof.

Referring to the drawings in more detail:

The reference numeral 1 generally indicates a fuel treating device suitable for the practice of this invention. The device 1 is illustrated connected to a reciprocating internal combustion engine 2, for example, of the stationary LSV-16, four cycle type manufactured by Cooper-Bessemer Co., Mount Vernon, Ohio and rated at over 5,000 horsepower at 400 rpm when fueled with natural gas. An engine of this type is suitable, for example, to drive a 5,000 horsepower, 125 KVA generator (not shown) for continuous electric power production.

Figure 1:
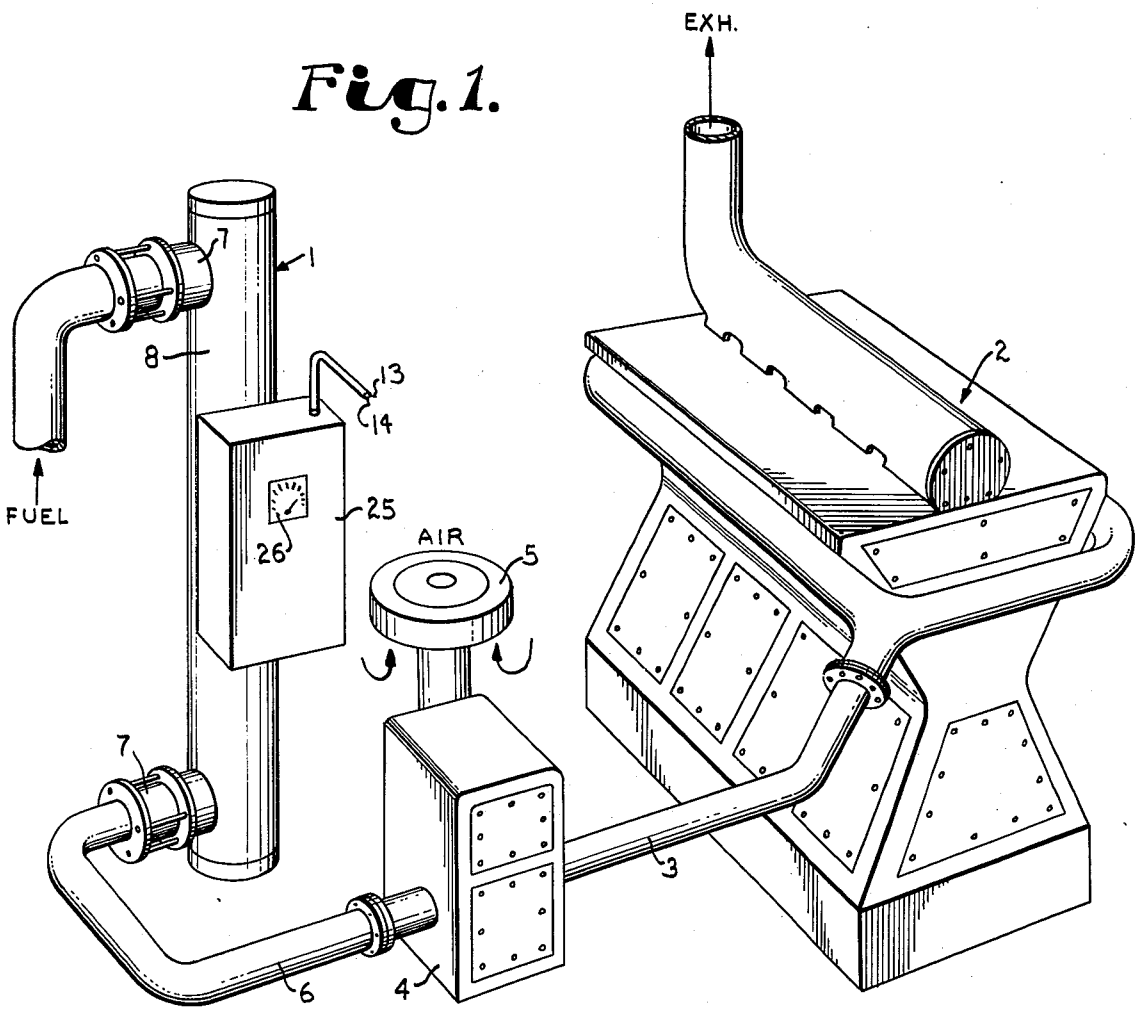
FIG. 1 is a partially schematic, perspective representation of a fuel treating device operably associated with a reciprocating internal combustion engine.

The engine 2 is shown schematically in FIG. 1 communicating through a fuel-air mixture transmission conduit 3 with a schematically illustrated super charging carburetor 4. The carburetor 4 receives air, and thereby oxygen, through a suitable filter unit 5, and gaseous fuel through an input conduit 6. The conduit 6 connects to the output 7 of the treating device 1 which receives the fuel through a suitable input conduit 7, for example, connected to a natural gas transmission piper line (not shown).

Referring particularly to FIG. 2, the device 1 comprises an outer metallic barrel 8, and an inner metallic barrel 9 coaxially mounted in spaced relation within the outer barrel, forming an annular flow passageway 10 therebetween. The inner barrel 9 is covered by an insulating coating 11 (shown greatly exaggerated in thickness) for example, of Teflon to reduce the tendency for electrical discharge across the passageway 10. In this example, an electrical circuit 12 is utilized to apply a relatively intense electrostatic field across the annular passageway 10 and includes input terminals 13 and 14 preferably adapted to receive commonly available electrical power thereacross, such as 110 volts A.C. The input current passes through a suitable fuse 15 and variable rheostat 16 to energize a primary transformer coil 17, which, in turn, energizes a secondary transformer coil 18 to a substantially higher A.C. voltage, for example, 6,000 to 14,000 volts. The higher A.C. voltage is rectified through suitable diodes 19 and 20 and capacitors 21 and 22, for example, of 4MFD capacity, to produce a high D.C. potential across the output terminals 23 and 24 which are respectively connected to the barrels 8 and 9. The circuit 12 is housed within an appropriate cabinet 25, preferably mounted on the device 1, and displays a meter 26 to indicate the output potential across the terminals 23 and 24.

It is well known that the available energy in fuels for reciprocating internal combustion engines is, in large measure, determined by the tendency of the fuel to detonate at lower-than-desired pressures within the cylinders. Although the physical or chemical modification of the fuel by the device 1 is not well understood, it has been demonstrated that the treatment materially decreases the tendency of the fuel to detonate, thereby producing several desirable changes in engine operation and resulting in a more efficient power system. For example, the use of the treater has been found to result in a drop in engine temperature, a lowering of peak instantaneous cylinder head pressure, less vibration, the ability to use a more efficient air-to-fuel ratio and a net increase in engine output per unit of fuel.

In attempting to determine what changes are produced in the fuel by utilizing the treater, the hydrocarbon composition of the fuel gas was determined under controlled conditions by standard procedures using a gas chromatograph. Approximately 9,000 V.D.C. (which included a slight A.C. ripple) was impressed across a treater having an outer barrel with a 10 inch inner diameter, an inner barrel with an 8 inch outer diameter ($8\frac{1}{4}$ inches with the insulation coating) and a flow passageway about 80 inches long. Natural gas at a rate of approximately 23,000 cubic feet per hour, and under a pressure of 23 psig, was directed through the treater (ambient 60° F.) and samples taken after passing therethrough and at a position remotely upstream from the treater. The following variations in the same fuel was noted as apparently caused by the treatment:

TABLE I

HYDROGEN COMPOSITION BY GAS CHROMATOGRAPH

| Components | Treated Mol. % | Untreated Mol. % |
|---|---|---|
| Helium | .20 | .21 |
| Nitrogen | 4.11 | 5.01 |
| Oxygen | 0 | 0 |
| Methane $CH_4$ | 85.12 | 82.96 |
| Ethane $C_2H_6$ | 6.92 | 6.17 |

TABLE I-continued

| HYDROGEN COMPOSITION BY GAS CHROMATOGRAPH | | |
|---|---|---|
| Components | Treated Mol. % | Untreated Mol. % |
| Propane $C_3H_8$ | 2.85 | 3.00 |
| Iso - Butane $C_4H_{10}$ | .09 | .47 |
| N - Butane $C_4H_{10}$ | .21 | 1.23 |
| Iso - Pentane $C_5H_{12}$ | .19 | .24 |
| N - Pentane $C_5H_{12}$ | .20 | .26 |
| Hexane Plus $C_6H_{14}$ | 0 | .21 |
| Heptane Plus $C_7H_{16}$ | 0 | 0 |
| Carbon Dioxide | .11 | .24 |

It has been suggested that the heavier components in the fuel hydrocarbon composition experienced a filling of unfilled carbon ring arrangements and/or a restructuring of hydrocarbons took place which resulted in an increase in methane, the major constituent contributing to a high octane rating, and the lighter fractions at the expense of the heavier fractions. Regardless of the cause, the operation of the engine was found to be noticeably improved, to the extent where a greater load could be applied without fuel detonation.

It is to be understood that while one form of this invention has been illustrated and described, it is not to be limited thereto except insofar such limitations are included in the following claims.

What is claimed and desired to secure by Letters Patent is:

1. In combination:

(a) a reciprocating internal combustion engine adapted for operation on gaseous fuel and having a carburetor associated therewith, (b) means connected to said engine and including a power supply directing a fuel modifying electrostatic field of about 6,000 to 14,000 volts across said gaseous fuel prior to the formation of a combustible mixture in said carburetor for use in said engine, (c) said means including an inner metallic cylinder and an outer metallic cylinder forming a passageway therebetween for said fuel and across which passageway said field is directed, (d) said inner metallic cylinder having an insulating coating thereover to reduce the tendency for electric discharge across said passageway, (e) said carburetor being operably located between said means and said engine whereby the fuel is treated by said means prior to carburetion.

* * * * *